US008651087B2

(12) United States Patent
Vick et al.

(10) Patent No.: US 8,651,087 B2
(45) Date of Patent: Feb. 18, 2014

(54) ENGINE WITH AN IMPROVED ARRANGEMENT OF THE CARBURETTOR UNIT

(75) Inventors: Christian Vick, Winsen/Luhe (DE); Mark Jesse, Hamburg (DE); Christoph Kahler, Pinneberg (DE)

(73) Assignee: Makita Corporation, Anjo-Shi (JP)

( * ) Notice: Subject to any disclaimer, the term of this patent is extended or adjusted under 35 U.S.C. 154(b) by 320 days.

(21) Appl. No.: 12/899,982

(22) Filed: Oct. 7, 2010

(65) Prior Publication Data

US 2011/0083636 A1 Apr. 14, 2011

(30) Foreign Application Priority Data

Oct. 14, 2009 (DE) ..... 20 2009 013 953 U

(51) Int. Cl.
*F02B 77/04* (2006.01)
*F02B 75/06* (2006.01)

(52) U.S. Cl.
USPC ..... 123/198 E; 123/192.1

(58) Field of Classification Search
USPC ..... 123/198 E, 26
See application file for complete search history.

(56) References Cited

U.S. PATENT DOCUMENTS

| | | | | |
|---|---|---|---|---|
| 3,542,095 | A | 11/1970 | Frederickson et al. | |
| 5,062,875 | A | 11/1991 | Nagashima | |
| 5,243,939 | A | 9/1993 | Viktorsson et al. | |
| 5,501,075 | A | 3/1996 | Spies et al. | |
| 7,389,754 | B2 * | 6/2008 | Holmdahl et al. | 123/26 |
| 2002/0144670 | A1 | 10/2002 | Ohsawa et al. | |

FOREIGN PATENT DOCUMENTS

| | | | |
|---|---|---|---|
| DE | 73 04 706 | U | 11/1973 |
| DE | 40 37 885 | A1 | 6/1991 |
| DE | 42 34 483 | A1 | 4/1993 |
| DE | 44 37 063 | A1 | 4/1995 |
| DE | 44 13 392 | C1 | 6/1995 |
| DE | 198 28 727 | A1 | 12/1999 |
| DE | 299 10 005 | U1 | 12/1999 |
| FR | 877 013 | A | 11/1942 |

OTHER PUBLICATIONS

German Search Report dated Mar. 16, 2010 in German Patent Application No. 20 2009 013 953.0 (with translation).
Nov. 25, 2011 Extended European Search Report issued in European Patent Application No. 10186882.6 (with translation).

* cited by examiner

*Primary Examiner* — Lindsay Low
*Assistant Examiner* — Syed O Hasan
(74) *Attorney, Agent, or Firm* — Oliff PLC

(57) ABSTRACT

In order to create an engine more preferably for a small working machine, for example for garden, forest and landscape work or for an engine-operated tool and the like, with a carburettor unit for mixture provision, in which carburettor unit via an inlet pipe is connected with a cylinder of the engine, wherein the cylinder extends along its piston running direction from its crankcase side as far as to its head end, and wherein a holding device is provided which serves for the mechanical holding of at least the carburettor unit and at least comprises an elastic element with an improved arrangement of the carburettor unit and easy removability of the carburettor, i.e. simple assembly and disassembly, it is proposed that the holding device with the at least one elastic element is provided between the carburettor unit and the cylinder and that the holding device is arranged above the inlet pipe in the direction towards the head end of the cylinder in such a manner that a suspended arrangement of the carburettor unit on the cylinder is formed.

9 Claims, 1 Drawing Sheet

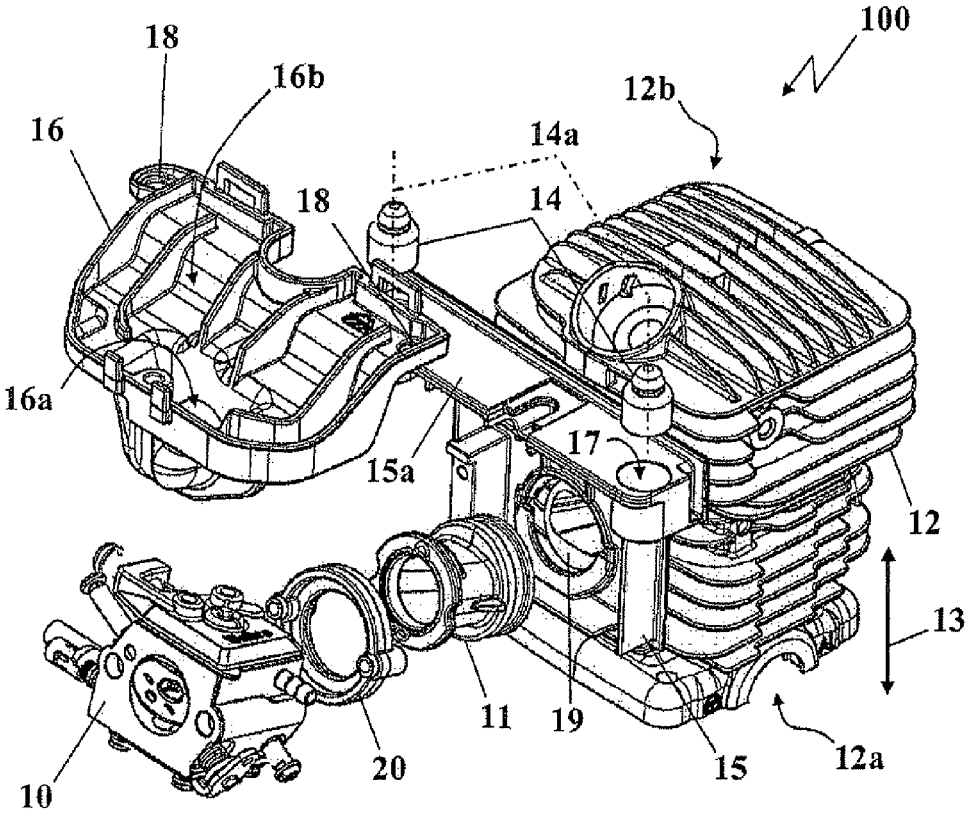
100
18
16b
12b
16
14a
18
14
16a
15a
17
12
13
11
19
10
20
15
12a

ENGINE WITH AN IMPROVED ARRANGEMENT OF THE CARBURETTOR UNIT

The present invention relates to an engine, more preferably for a light working machine, for example for garden, forest and landscape work or for an engine-driven tool and the like, with a carburettor unit for mixture provision, which carburettor unit is connected with a cylinder of the engine via an inlet pipe, wherein the cylinder extends along its piston running direction from its crankcase side to its head end, and wherein a holding device is provided which serves for the mechanical mounting of at least the carburettor unit and comprises at least one elastic element.

PRIOR ART

Engines for light working machines are frequently embodied as two-stroke combustion engines. Such light working machines are known for garden, forest and landscape work such as chain saws, hedge shears, lawnmowers, lawn trimmers, leaf clearing devices and the like. Engines of this type are furthermore used for engine-driven tools such as disc grinders and the like.

Such an engine comprises a carburettor unit for mixture provision which among other things is connected with a cylinder of the engine via an inlet pipe. The connecting point in this case relates to the inlet point in the cylinder through which the conditioned gas is able to enter the combustion chamber. This inlet point is arranged at a height along the piston running direction of the cylinder which is located between the crankcase side of the cylinder and the head end of the latter. The inlet pipe as well as the carburettor unit extend in a straight line or preferentially obliquely away from the cylinder wall so that for the holding mounting of the carburettor unit a holding device is necessary. The mechanical mounting of the carburettor unit in this case is effected by the holding device or at least one elastic element so that the holding arrangement of the carburettor unit on the engine is effected via both the inlet pipe as well as the at least one elastic element.

From DE 299 10 005 U1 an engine of the present type is known which has a carburettor unit that is held on a housing surrounding the engine. The arrangement of the carburettor unit on the housing is effected via an elastic sleeve which is arranged in the housing bottom below the carburettor unit, i.e. in the direction towards the crankcase side of the cylinder. Disadvantageous here is the difficult removability of the carburettor unit since during the assembly and disassembly the elastic sleeve is covered by the carburettor unit itself. A holding device between the cylinder unit and the housing is furthermore unfavourable since vibration amplitudes between the engine and the housing as well as the housing and the carburettor unit can add up. The objective however is a preferably minimum vibration arrangement of the carburettor unit since optimum mixture provision can only be achieved then. Through the more elaborate damping elastic configurations of the sleeves are required which can frequently turn out to be complicated and can tear over extended use of the engine. These configurations can for example be effected through ring-shaped damping bodies wherein it is desirable to use an elastic element and to arrange the latter so that such yielding regions in the elastic element can be omitted.

DESCRIPTION OF THE INVENTION

Object, Solution, Advantages

It is therefore the object of the present invention to overcome the disadvantages of the aforementioned prior art and to create an engine with an improved arrangement of the carburettor unit, it is more preferably the object of the present invention to create easy removability of the carburettor, i.e. simple assembly and disassembly. It is furthermore the object of the present invention to make possible an optimal vibration arrangement of the carburettor unit in order to minimize the dynamic loading of the carburettor unit and to improve the mixture provision.

This object is solved based on an engine according to claim 1. Advantageous further developments of the invention are stated in the dependent claims.

The invention includes the technical teaching that the holding device with the at least one elastic element is provided between the carburettor unit and cylinder and that the holding device is arranged above the inlet pipe in the direction towards the head end of the cylinder in such a manner that a hanging arrangement of the carburettor unit on the cylinder is formed.

Here, the invention is based on the idea that the arrangement of the carburettor unit in addition to the connection of the carburettor unit via the inlet pipe to the cylinder is also effected via a holding device on the cylinder itself. Here, at least one elastic element can be located in the force flow between the carburettor unit and the cylinder. According to the invention it is provided that the holding device is arranged above the inlet pipe in the direction of the head end of the cylinder. The arrangement of the holding device provided above in the direction of the head end of the cylinder describes a connection of the holding device with the cylinder on the free end of the cylinder so that the inlet pipe is present between the holding device and the crankcase side of the cylinder. Obviously the holding device can also be connected with the cylinder at its head end. Thus a hanging arrangement of the carburettor unit on the cylinder is created so that a connection of the holding device of the carburettor unit with the housing of the engine or with the crankcase can be omitted which creates clearly improved removability of the carburettor, i.e. simplified assembly and disassembly.

According to an advantageous further development of the arrangement according to the invention the cylinder comprises an intermediate flange with a carrier bridge which is arranged above the inlet pipe in the direction of the head end of the cylinder. Preferentially the intermediate flange with the carrier bridge is determined as part of the holding device, wherein the intermediate flange can also be produced in one piece and for example of the same material as the cylinder, or the intermediate flange is connected with the cylinder via connecting means. The carrier bridge is arranged above the inlet pipe in the direction of the head end of the cylinder so that the arrangement of the carrier bridge corresponds to the arrangement of the holding device above the inlet pipe in the direction of the head end of the cylinder. The carrier bridge is provided for accommodating the holding device in order to connect the holding device with the cylinder. Obviously the holding device can also be directly connected with the cylinder so that the intermediate flange with the carrier bridge is omitted.

It is furthermore of advantage that an intake manifold is provided and at least fowls one part of the holding device. The intake manifold can preferentially be arranged adjoining the carburettor unit and be connected with the latter mechanically and preferentially also fluidically so that the intake manifold foinis an air intake channel. More preferably the intake manifold can be folioed to accommodate an air filter wherein the mechanical connection of the intake manifold with the carburettor unit is configured as non-elastic substantially stiff connection.

Preferentially, two elastic elements can be provided which are arranged between the intake manifold and the cylinder and more preferably the carrier bridge of the intermediate flange so that via the two elastic elements and via the inlet pipe a three-point arrangement of the carburettor unit with the intake manifold is formed on the cylinder. The two elastic elements can be arranged spaced from each other between the carrier bridge of the intermediate flange and the intake manifold. The carrier bridge forms a mounting structure with two openings, wherein an elastic element can be mounted in each opening. The elastic element can preferentially have a cylinder-like shape and extend along a cylinder axis while the arrangement of the cylinder axis is substantially orientated parallel to the piston direction.

In order to create advantageous vibration damping of the carburettor unit with respect to vibration of the cylinder it is advantageous that the connection of the carburettor unit with the cylinder and preferentially the inlet pipe itself has an elasticity that is intended to minimize the vibration transmission of the vibration of the cylinder to the carburettor unit. More preferably it is advantageous that the carburettor unit and the intake manifold form an overall mass capable of vibration and that the holding device and the inlet pipe have a yield which is determined in such a manner that vibration excitation of the total mass through the operation of the engine is minimal.

The elastic element can more preferably consist of a rubber, a caoutchouc or a synthetically produced soft plastic. Thus, vibrations of the cylinder are not passed on to the intake manifold. This results in a resting or minimal vibration arrangement of the carburettor unit on the cylinder, while vibration damping via the inlet pipe is made possible for example through a bellows-like section of the inlet pipes so that vibrations of the cylinder are not substantially transmitted to the carburettor unit by the inlet pipe.

The intake manifold thus assumes the function as both part of the holding device between the carburettor unit and the carrier bridge, on which the intake manifold is connected with the elastic elements, and also the function of accommodating an air filter through which the charge air of the engine flows. Below the mounting region for the air filter the intake manifold comprises an air intake channel which terminates in the carburettor unit. At the same time, the region of the air intake channel forms the connecting point of the intake manifold with the carburettor unit, wherein the intake manifold comprises two mounting geometries which are arranged in the intake manifold spaced from each other and which serve to accommodate the elastic elements. Consequently a three-point arrangement between the carrier bridge and the carburettor unit is obtained for the intake manifold.

BRIEF DESCRIPTION OF THE DRAWINGS

Further measures improving the invention are shown in more detail in the following jointly with the description of a preferred exemplary embodiment of the invention by means of a single FIGURE. It shows:

The FIGURE a perspective view of an arrangement of a carburettor unit on a cylinder of an engine according to the present invention.

PREFERRED EMBODIMENT OF THE INVENTION

The FIGURE shows an exemplary embodiment of the present invention in a perspective, flying view. Shown is an engine 100, wherein the representation is substantially limited to the arrangement of the cylinder 12 as well as of the carburettor unit 10 with the holding device according to the invention. The engine 100 is used for example in light working machines, for example for garden, forest and landscape work, wherein such engines 100 are also used for engine-driven tools such as disc grinders or similar.

The cylinder 12 of the engine 100 at the bottom comprises a crankcase side 12*a* on which a crankcase of the engine 100 connects with the cylinder 12, but which is not shown in more detail. The cylinder 12 extends along a piston running direction 13, shown by a double arrow between the crankcase side 12*a* and a head end 12*b* of the cylinder 12. The conditioned mixture for operating the engine 100 enters the combustion chamber of the cylinder 12 through an inlet channel 19, wherein the conditioned mixture is provided by the carburettor unit 10 and conducted to the inlet channel 19 via an inlet pipe 11. Between the carburettor unit 10 and the inlet pipe 11 a further element is shown which serves for the assembly of the carburettor unit 10 and is embodied as flange ring 20.

The inlet channel 19 is located in the wall of the cylinder 12 at a point between the crankcase side 12*a* and the head end 12*b* of the cylinder 12, while the inlet channel 19 is arranged along the piston running direction 13 at a height which is situated closer to the crankcase side 12*a* than to the head end 12*b*.

On the side of the cylinder 12 on which is located the inlet channel 19 and thus the arrangement of the carburettor unit 10 the cylinder 12 comprises an intermediate flange 15. Said intermediate flange can be embodied as one piece with the cylinder 12, while the intermediate flange 15 can also be connected with the cylinder 12 via connecting means. The intermediate flange 15 comprises a carrier bridge 15*a* which extends transversely to the piston running direction 13 and forms a type of line on which according to the invention the holding device for the arrangement of the carburettor unit 10 on the cylinder 12 can be attached. Consequently the intermediate flange 15 preferentially serves for the arrangement of the carburettor unit 10 on the cylinder 12 and can be considered as part of the holding device according to the present invention.

The carrier bridge 15*a* of the intermediate flange 15 is located above the inlet channel 19 on the cylinder 12. Thus the carrier bridge 15*a* has a position between the connecting point of the inlet pipe 11 to the cylinder 12 and the head end 12*b* of the cylinder 12.

The holding device according to the invention furthermore comprises an intake manifold 16 comprising an intake channel 16*a* in order to connect the intake manifold 16 with the carburettor unit 10 both mechanically and fluidically. The intake manifold 16 can have a mounting region 16*b* which serves to accommodate an air filter through which the charge air for operating the engine 100 flows, wherein the charge air after its flow through the air filter—the latter is not shown in detail—flows through the air intake channel 16*a* in order to enter the carburettor unit 10.

According to the invention the carburettor unit 10 via the intake manifold 16 is mechanically connected with the carrier bridge 15*a* of the intermediate flange 15 and consequently with the cylinder 12. The connection of the intake manifold 16 with the carrier bridge 15*a* comprises two elastic elements 14 which are embodied as rubber elements. The elastic elements 14 are configured cylindrical in shape and extend along a respective cylinder axis 14*a*, while the cylinder axes 14*a* run spaced parallel to each other and approximately parallel to the piston running direction 13. The elastic elements 14 can be inserted in openings 17 which in turn are produced in the carrier bridge 15*a* of the intermediate flange 15.

The elastic elements 14 allow a damping effect of the vibration of the cylinder 12 caused through the operation of the engine 100. In order to arrange the carburettor unit 10 preferably resting on the cylinder 12, the carburettor unit 10 initially comprises a non-elastic stiff connection to the intake manifold 16. By means of this the carburettor unit 10 forms an overall mass with the intake manifold 16, while the spring-mass system provides damping through the elastic element 14 which is designed so that the overall mass of carburettor unit 10 and intake manifold 16 is subjected to minimum vibration excitation.

By mounting the intake manifold 16 at the top on the cylinder 12 above the inlet pipe 11 a hanging arrangement of the carburettor unit 10 on the cylinder 12 is created. Vibration damping is more preferably made possible in that the elastic elements merely pass through mounting geometries 18 which are produced in the intake manifold 16. Thus, safe fastening of the carburettor unit 10 and the intake manifold 16 on the cylinder 12 can be made possible without vibrations of the cylinder 12 being substantially transmitted to the total mass of carburettor unit 10 and intake manifold 16.

The shown exemplary embodiment of the engine 100 according to the invention with corresponding arrangement of the carburettor unit 10 provides the advantage that the carburettor unit 10 need not be arranged on the housing of the engine 100 or the light working machine by way of elaborately configured elastic units. Consequently there are a minimum number of elements in the connecting chain for the arrangement of the carburettor 10 on the engine 100. Here it must be taken into account that the intermediate flange 15 with the carrier bridge 15*a* merely constitutes an advantageous configuration of the invention so that the intake manifold 16 upon omission of the intermediate flange 15 with the carrier bridge 15*a* can also be directly arranged on the cylinder 12 via at least one and preferentially two elastic elements 14. However, the arrangement of the carburettor unit 10 according to the invention does not comprise any housing parts of housing components which are consequently present on the engine 100 as part of the holding device for the arrangement of the carburettor unit 10. In particular it offers the advantage that through the hanging arrangement of the carburettor unit 10 improved assembly and disassembly and particularly improved maintenance of the carburettor unit 10 is made possible.

The invention in its embodiment does not limit itself to the preferred exemplary embodiment stated above. On the contrary, a number of versions are conceivable which make use of the shown solution even with embodiments of a fundamentally different type. All features and/or advantages including design details, spatial arrangements and method steps emanating from the claims, the description or the drawings can be substantial to the invention both by themselves as well as in any combinations.

LIST OF REFERENCE CHARACTERS

100 Engine
10 Carburettor unit
11 Inlet pipe
12 Cylinder
12*a* Crankcase side
12*b* Head end
13 Piston running direction
14 Elastic element
14*a* Cylinder axis
15 Intermediate flange
15*a* Carrier bridge
16 Intake manifold
16*a* Air intake channel
16*b* Mounting region for air filter
17 Opening
18 Mounting geometry
19 Inlet channel
20 Flange ring

The invention claimed is:

1. An engine, with a carburettor unit for mixture provision, in which the carburettor unit via an inlet pipe is connected with a cylinder of the engine, wherein the cylinder extends along its piston running direction from its crankcase side as far as to its head end, and wherein a holding device is provided which serves for the mechanical holding of at least the carburettor unit and comprises two elastic elements, wherein the holding device with the two elastic element elements is provided between the carburettor unit and the cylinder and that the holding device is arranged above the inlet pipe in the direction towards the head end of the cylinder in such a manner that a suspended arrangement of the carburettor unit on the cylinder is formed, the two elastic elements are provided such that via the two elastic elements and via the inlet pipe, a 3-point arrangement of the carburettor unit on the cylinder is formed, the 3-point arrangement defining distinct and separate points of attachment on the cylinder, the points of attachment for each elastic element being located away from the point of attachment of the inlet pipe in a direction towards the head end of the cylinder.

2. The engine according to claim 1, wherein the cylinder comprises an intermediate flange with a carrier bridge which is arranged above the inlet pipe in the direction towards the head end of the cylinder.

3. The engine according to claim 1, wherein an intake manifold is provided which forms at least a part of the holding device.

4. The engine according to claim 3, wherein one of the elastic elements is arranged between the carrier bridge of the intermediate flange and the intake manifold.

5. The engine according to claim 3, wherein the intake manifold is arranged adjoining the carburettor unit and is mechanically and fluidically connected with the latter so that the intake manifold forms an air intake port.

6. The engine according to claim 3, wherein the intake manifold is designed for holding an air filter, wherein the mechanical connection of the intake manifold with the carburettor unit is configured as non-elastic substantially stiff connection.

7. The engine according to claim 2, wherein the carrier bridge comprises at least one opening which is designed for holding one of the elastic elements wherein the elastic element has a cylindrical shape and extends along a cylinder axis which is substantially orientated parallel to the piston running direction.

8. The engine according to claim 1, wherein the connection of the carburettor unit with the cylinder and the inlet pipe has an elasticity which is defined in such a manner that vibration damping of the carburettor unit relative to the vibration of the cylinder is created.

9. The engine according to claim 3, wherein the carburettor unit and the intake manifold form a total mass capable of vibration and that the holding device and the inlet pipe have a resilience which is defined in such a manner that vibration excitation of the total mass through the operation of the engine is minimal.

* * * * *